United States Patent [19]

Rhodes

[11] Patent Number: 4,740,294

[45] Date of Patent: Apr. 26, 1988

[54] METHOD FOR SEQUENTIALLY CO-PROCESSING HEAVY HYDROCARBON AND CARBONACEOUS MATERIALS

[75] Inventor: Donald E. Rhodes, Oklahoma City, Okla.

[73] Assignee: Kerr-McGee Corporation, Oklahoma City, Okla.

[21] Appl. No.: 653,890

[22] Filed: Sep. 25, 1984

[51] Int. Cl.[4] ..... C10G 1/06; C10G 1/00

[52] U.S. Cl. ..... 208/413; 208/415; 208/423; 208/434

[58] Field of Search ..... 208/10, 8 LE, 112

[56] References Cited

U.S. PATENT DOCUMENTS

| | | | |
|---|---|---|---|
| 4,054,504 | 10/1977 | Cherverak et al. | 208/10 |
| 4,214,977 | 7/1980 | Ronganathan et al. | 208/10 X |
| 4,313,819 | 2/1982 | Rodo | 208/8 LE |
| 4,330,390 | 5/1982 | Rosenthal et al. | 208/10 |
| 4,338,183 | 7/1982 | Gatsis | 208/10 |
| 4,339,329 | 7/1982 | Kageyama et al. | 208/10 |
| 4,372,838 | 2/1983 | Kulik et al. | 208/10 |
| 4,461,694 | 7/1984 | Givens et al. | 208/8 LE |

FOREIGN PATENT DOCUMENTS

| | | |
|---|---|---|
| 57-70185 | 4/1982 | Japan . |
| 57-100188 | 6/1982 | Japan . |

*Primary Examiner*—Curtis R. Davis
*Assistant Examiner*—William G. Wright
*Attorney, Agent, or Firm*—William G. Addison; John P. Ward

[57] ABSTRACT

A method for sequentially co-processing heavy hydrocarbon materials and carbonaceous materials comprising first subjecting the heavy hydrocarbon material in the presence of a disposable metal catalyst to produce and separate therefrom a first distillate stream and a first non-distillable effluent stream containing the disposable metal catalyst. The first non-distillable effluent stream then is mixed with the carbonaceous material and the mixture subjected to liquefaction conditions in the presence of said disposable metal catalyst. The liquefaction product then is subjected through the use of sequential fractionation and critical solvent extraction processing steps to separate and recover various heavy hydrocarbon and carbonaceous-derived light hydrocarbon liquid products therefrom.

21 Claims, 1 Drawing Sheet

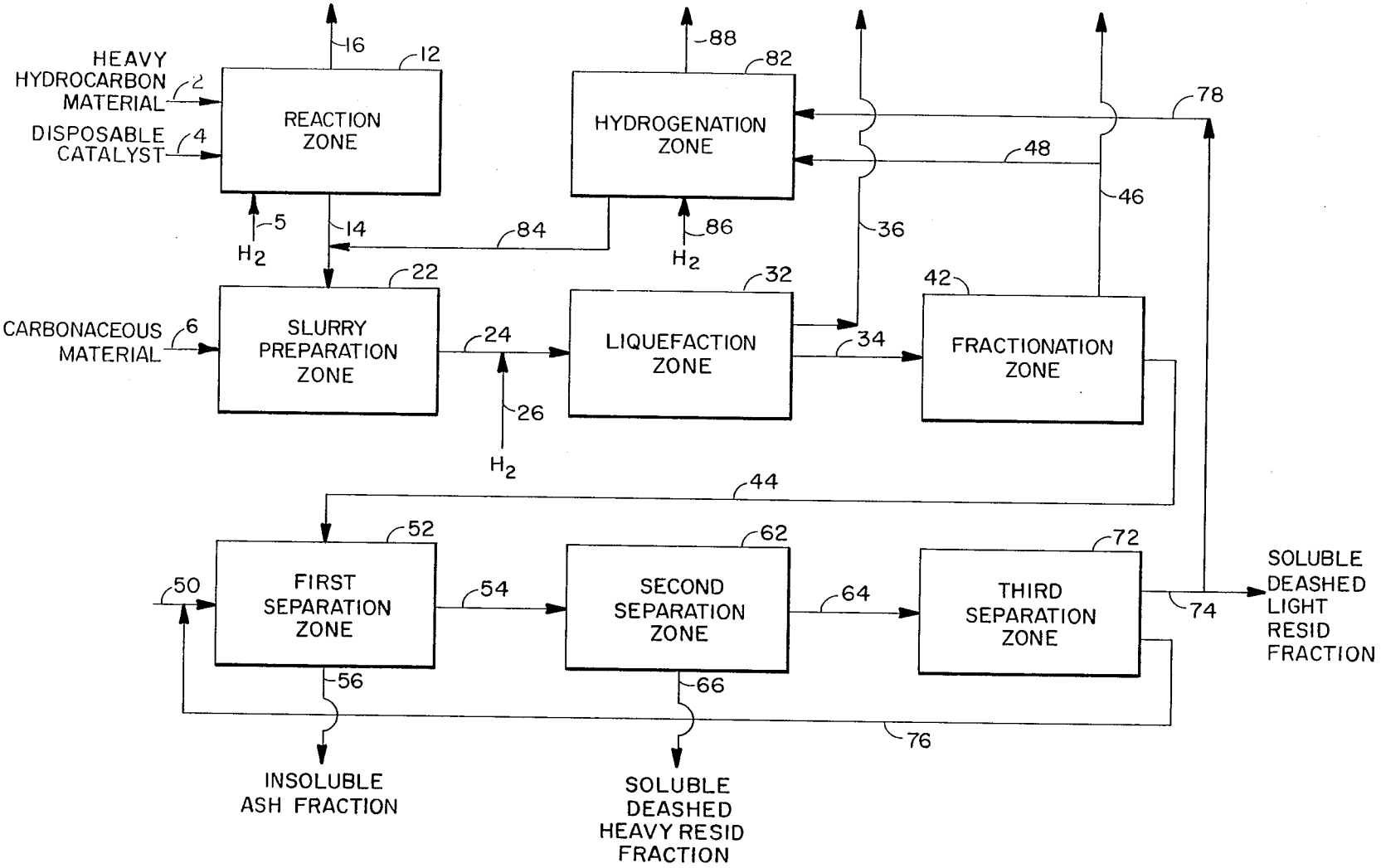
HEAVY HYDROCARBON MATERIAL
DISPOSABLE CATALYST
CARBONACEOUS MATERIAL
REACTION ZONE
SLURRY PREPARATION ZONE
LIQUEFACTION ZONE
HYDROGENATION ZONE
FRACTIONATION ZONE
FIRST SEPARATION ZONE
SECOND SEPARATION ZONE
THIRD SEPARATION ZONE
$H_2$
$H_2$
$H_2$
INSOLUBLE ASH FRACTION
SOLUBLE DEASHED HEAVY RESID FRACTION
SOLUBLE DEASHED LIGHT RESID FRACTION
2
4
6
5
12
14
16
22
24
26
32
34
36
42
44
46
48
50
52
54
56
62
64
66
72
74
76
78
82
84
86
88

METHOD FOR SEQUENTIALLY CO-PROCESSING HEAVY HYDROCARBON AND CARBONACEOUS MATERIALS

CROSS REFERENCE TO RELATED APPLICATIONS

Aspects of the present invention are related to subject matter disclosed in co-pending application Ser. No. 653,891, entitled "A Method for the Co-Processing of Carbonaceous and Heavy Hydrocarbon Blends", and co-pending application Ser. No. 653,884, entitled "A Method for Treating Heavy Hydrocarbons Using Disposable Catalysts" both filed on an even date herewith and both assigned to the same assignee as the present invention.

FIELD OF THE INVENTION

This invention relates to a method for sequentially co-processing heavy hydrocarbon materials and carbonaceous materials. More particularly, the present invention relates to a method of sequentially co-processing heavy hydrocarbon and carbonaceous materials employing a process-derived solvent system and at least one disposable metal catalyst.

BACKGROUND OF THE INVENTION

Numerous methods are known for effecting the conversion of solid carbonaceous materials such as raw particulate coal into useful intermediate products. Generally, these methods comprise the liquefaction of the particulate coal under conditions of elevated temperature and pressures and subsequent separation of the liquefaction product into its constituent solid and liquid fractions. Although the solid fraction has some residual value for use in the production of hydrogen, fuel gas, coker distillates and coke, the liquid fractions recovered as the result of said subsequent separation are the desired and significantly more valued products. The liquid fraction or fractions are more valuable since such fractions represent a source of a variety of liquid hydrocarbons usually obtained only from petroleum and, in addition, can be readily processed by conventional hydrocarbon processing techniques.

Methods also have been devised for accomplishing the simultaneous conversion of mixtures comprised of heavy hydrocarbon materials and solid carbonaceous materials, e.g., oil components and coal. Exemplary of such methods is the process described in U.S. Pat. No. 4,054,504. The process described therein consists of premixing coal and a crude oil comprising at least about 20 percent of residuum oil boiling above about 1,000° F. and subjecting said premix to elevated temperatures and pressures in the presence of hydrogen and a hydrogenation catalyst to convert said coal and the residuum oil components in said crude oil to distillable liquid and gaseous hydrocarbon products. The distillable liquid and gaseous hydrocarbon products are then separated and recovered by conventional means.

A further example of a method for the simultaneous conversion of a blend of a solid carbonaceous material such as coal and a heavy hydrocarbon material such as topped or reduced crude oils is that disclosed in U.S. Pat. No. 4,338,183. Therein is disclosed a method wherein a blend of coal and a topped or reduced crude oil is subjected to elevated temperatures and pressures in a liquefaction zone in the presence of hydrogen and a recycle stream containing substantial quantities of asphaltenes and an unsupported finely divided metal catalyst. A particular objective of the process described in this patent is the extraction of valuable liquid products from the solid carbonaceous material in the blend and the simultaneous conversion of a part of the heavy hydrocarbon material in the blend from a less desirable material to a more desirable material.

Still a further example of a method for the simultaneous conversion of a blend or admixture of a solid carbonaceous material and a heavy hydrocarbon material is co-pending application Ser. No. 653,891 referred to hereinabove. Therein is described a method for the co-processing of an admixture of a solid carbonaceous material, heavy hydrocarbon material, a process-derived recycled solvent system and a disposable metal catalyst. The admixture is subjected to liquefaction, fractionation and subsequent critical solvent extraction with the recovery of various distillable and non-distillable fractions containing mixtures of products derived from the carbonaceous and heavy hydrocarbon materials in the original admixture.

Although the above-referenced methods work quite well for the purposes for which they were developed, there still remains a need for a co-processing method wherein the quantity and quality of distillate products obtainable from such co-processing can be improved.

SUMMARY OF THE INVENTION

The present invention comprises a method for sequentially co-processing a heavy hydrocarbon material and a carbonaceous material to improve both the quantity and quality of various distillate products which can be derived from these materials.

In its broadest aspects, the present invention comprises first subjecting a heavy hydrocarbon material to elevated temperatures and pressures in the presence of a disposable metal catalyst to recover a first distillate stream and provide a first non-distillable effluent stream containing residual heavy hydrocarbon material and non-disposable metal catalyst.

The first non-distillable effluent stream, containing disposable metal catalyst, then is combined with a carbonaceous material and at least one process-derived solvent selected from the group consisting of a process-derived distillate solvent having an atmospheric boiling point of at least about 500° F. and a process-derived, deashed light resid solvent to form a liquefaction slurry mixture. This slurry mixture then is subjected to predetermined temperatures and pressures in a liquefaction zone. The liquefaction product stream exiting said liquefaction zone contains a mixture of desired products. These include products derived from both the residual heavy hydrocarbon material as well as the carbonaceous material of the liquefaction slurry mixture introduced to said liquefaction zone.

The liquefaction product stream exiting the liquefaction zone then is subjected to separation in a fractionation zone. This fractionation is carried out at elevated temperatures and, in a preferred embodiment, reduced pressures for a time sufficient to effect a separation of said liquefaction product stream into a second distillate stream and a second non-distillable effluent stream. At least a portion of the second distillate stream can be utilized as the process-derived, distillate solvent in preparing the liquefaction slurry mixture described hereinabove.

The second non-distillable effluent stream obtained from the fractionation zone then is subjected to solvent-extraction under critical solvent extraction conditions of elevated temperatures and pressures in a suitable separation zone using as an extraction solvent, a hydrocarbon liquid having a critical temperature below about 800° F. In the separation zone, the second non-distillable effluent stream is divided, in accordance with its solubility characteristics in the extraction solvent employed, into an ash concentrate fraction (i.e., an ash rich fraction containing some solvent-soluble deashed heavy resid fraction and some solvent), a solvent-soluble, deashed heavy resid fraction and a solvent-soluble, deashed light resid fraction. At least a portion of this solvent-soluble, deashed light-resid fraction can be utilized as the process-derived, deashed light resid solvent in preparing the liquefaction slurry mixture employed in the practice of this invention.

In a preferred embodiment, the process-derived solvent utilized in the method of this invention will comprise a hydrotreated solvent. This hydrotreated solvent will be prepared by hydrogenating at least one process-derived, distillate solvent and the process-derived, deashed light resid solvent with hydrogen or a hydrogen-containing gas in the presence of a suitable hydrogenation catalyst. In a most preferred embodiment, the process-derived solvent utilized in the method of this invention will be a hydrotreated, process-derived mixed solvent system comprising the process-derived, distillate solvent and process-derived, deashed light resid solvent described hereinbelow.

BRIEF DESCRIPTION OF THE DRAWING

The single FIGURE is a schematic illustration of the principal steps or stages employed in the practice of the novel method described herein and particularly illustrate the most preferred embodiment of this novel method.

DESCRIPTION OF THE PREFERRED EMBODIMENTS

Referring now to the single FIGURE, a heavy hydrocarbon material, disposable metal catalyst and hydrogen are conveyed through conduits 2, 4 and 5, respectively, to reaction zone 12. In an alternative embodiment (not illustrated), a diluent oil such as pyrogenous bitumen, native bitumen and carbonaceous-derived oils also can be introduced into reaction zone 12 to provide increased fluidity and pumpability to the heavy hydrocarbon material and to the first non-distillable effluent stream recovered from reaction zone 12 through conduit 14. The use of such diluent oils in the present invention also provides a means for upgrading these diluent oils to more valuable products. Representative, but non-limiting, examples of pyrogenous bitumen-, native bitumen and carbonaceous-derived diluent oils that can be utilized in this alternative embodiment include various API gravity vacuum gas oils, heavy API gravity oils resulting from the critical solvent extraction of vacuum distillation residuums, residual oil "leftovers" from various refining processes and oils recovered from the liquefaction of various coals such as bituminous, subbituminous, lignite and brown coals as well as peat. In general, when utilizing such diluent oils in accordance with this alternative embodiment, said diluent oils will be introduced into reaction zone 12 in amounts ranging from about 5 percent to about 200 percent by weight based on the weight of that fraction of the heavy hydrocarbon having an atmospheric boiling point of at least 850° F. and greater.

In reaction zone 12, the heavy hydrocarbon material is subjected to predetermined temperature and pressure conditions, in the presence of said disposable metal catalyst and hydrogen or a hydrogen-containing gas, sufficient to effect a conversion, i.e., cracking, of at least a portion of said heavy hydrocarbon material into lighter hydrocarbon products. Generally, in order to effect this conversion, the heavy hydrocarbon material within reaction zone 12 will be heated to temperatures ranging from about 600° F. to about 900° F. at pressures ranging from about 50 pounds per square inch gauge (psig) to about 4,000 psig. The preferred temperatures and pressures, however, will range from about 700° F. to about 850° F. and from about 500 psig to about 3,000 psig, respectively. At these temperatures and pressures, the time of reaction can range from about 0.2 to about 2.0 hours with a reaction time ranging from about 0.5 to about 1.0 hours being preferred.

The disposable metal catalysts introduced into reaction zone 12 through conduit 4 and effecting the conversion of the heavy hydrocarbon material in reaction zone 12 are compounds of iron selected from the group consisting of iron oxides and iron sulfides (including the mono- and disulfides of iron). Such compounds of iron include those which occur naturally in various iron ores as well as those which are produced synthetically. For example, iron oxide and sulfide concentrates prepared by means of beneficiation of such naturally occurring iron ores as magnetite ($Fe_3O_4$), hematite ($Fe_2O_3$), pyrite ($FeS_2$), marcasite ($FeS_2$), also known as white iron pyrite, pyrrhotite (FeS) and the like exhibit a level of catalytic activity suitable for use in the method comprising this invention. Means for beneficiating such iron ores to produce the concentrates useful in this invention are well-known and usually include steps such as crushing, screening and washing of the iron ores to thereby increase the iron contents therein. In general, the iron content of an as-mined iron ore can be increased from as little as 15–20 percent by weight of iron in the original iron ore up to about 60 or 65 percent by weight or higher in the final concentrate. For use in the present invention, such iron ore concentrates further will be ground to a particle size of 60 mesh (Tyler screen) or finer for mixing with the heavy hydrocarbon materials.

Also, as disclosed hereinabove, synthetically produced iron oxides and iron sulfides are useful in the practice of the method of the present invention. Synthetic iron oxides can be prepared by, for example, oxidative roasting of pyrite, by spray-roasting spent pickling or leach liquors generated in iron and steel cleaning operations and the beneficiation of titaniferous ores to produce synthetic rutile, by the action of steam on heated iron, by electrolysis of alkaline metal sulfates in diaphragm cells using wrought iron anodes and the like. Synthetic iron sulfides useful as disposable catalysts in the practice of the present invention include, for example, those prepared by the addition of an alkaline sulfide to a solution of an iron (II) compound, by direct reaction between the elements iron and sulfur, by the action of hydrogen sulfide on iron (III) chloride at red heat or by heating iron (II) sulfide with an excess of sulfur and the like.

Of the various naturally occurring and synthetically produced iron oxides and iron sulfides described hereinabove, the most efficacious catalysts are the synthetically produced iron oxides and particularly those iron oxides recovered from the spray-roasting of spent pickle and leach liquors.

Although the above-described disposable iron oxides work very well in effecting conversion of the heavy hydrocarbon material to more desirable constituents, it is within the scope of the present invention to employ compounds which, when contacted with the iron oxides, can effectively further enhance the catalytic activity of these iron oxides. Compounds which have been been found to effectively enhance the catalytic activity of the iron oxides employed in the present invention include hydrogen sulfide and sulfur-containing compounds which, when subjected to the elevated temperature and pressure conditions in liquefaction zone 32, generate hydrogen sulfide in-situ. Representative, but non-limiting, examples of such sulfur-containing compounds include hydrogen trisulfide, carbon disulfide, dimethyl disulfide and the like.

The amount of disposable catalyst mixed with the heavy hydrocarbon material in reaction zone 12 will be an amount sufficient to effect catalytic conversion of the heavy hydrocarbon material. Generally, the amount of disposable catalyst mixed with said heavy hydrocarbon material will range from about 0.1 parts to about 10 parts by weight and preferably from about 0.5 to about 5.0 parts by weight per 100 parts by weight of the +850° F. and higher boiling fractions in the heavy hydrocarbon material.

When, as disclosed above, hydrogen sulfide or a sulfur-containing compound capable of generating hydrogen sulfide is employed in combination with said disposable catalyst, said hydrogen sulfide or sulfur-containing compound will be added in an amount ranging from about 0.2 parts to about 20 parts per 100 parts by weight of said heavy hydrocarbon material. Preferably, said hydrogen sulfide or sulfur-containing compound will range from about 1.0 parts to about 10.0 parts by weight per 100 parts by weight of said heavy hydrocarbon material.

As the conversion of the heavy hydrocarbon material, and when operating in accordance with the above-described alternative embodiment, the conversion of the diluent oil as well, in reaction zone 12 proceeds, there is produced a first distillate stream. This first distillate stream comprises a mixture of light hydrocarbon fractions, including, for example, gasoline, naphtha, kerosene and other steam distillable light hydrocarbon fractions having atmospheric boiling points ranging up to about 850° F. As the conversion reaction proceeds, this first distillate stream is removed from reaction zone 12 through conduit 16 and recovered for further refining (by means not shown) to separate said first distillate stream and recover individually light hydrocarbon fractions such as those mentioned above.

There is further produced in reaction zone 12 a first non-distillable effluent stream. This first non-distillable effluent stream comprises a mixture of heavy hydrocarbon fractions, said fractions having atmospheric boiling points of at least about 850° F. and higher and which is recovered from reaction zone 12 by way of conduit 14.

Referring once again to the single FIGURE illustrating the most preferred embodiment, the first non-distillable effluent stream then is combined with a hydrogenated, process-derived mixed solvent system, described in greater detail hereinbelow, introduced into conduit 14 through communicating conduit 84. The combination of said first non-distillable effluent stream and said hydrogenated, process-derived mixed solvent system then is introduced into slurry preparation zone 22 wherein it is admixed with a carbonaceous material, defined below. The carbonaceous material is added to preparation zone 22 through conduit 6. Alternatively, said hydrogenated, process-derived mixed solvent system can be added directly to slurry preparation zone 22 by means of a conduit (not shown) providing direct communication between hydrogenation zone 82 and slurry preparation zone 22.

In yet another embodiment of the method of the present invention, the hydrogenated, process-derived mixed solvent system can be added directly to reaction zone 12. In this embodiment, the first distillate stream recovered from reaction zone 12 through conduit 16 will not only comprise a mixture of light hydrocarbon fractions resulting from the conversion of at least a portion of the heavy hydrocarbon material in reaction zone 12 but also light hydrocarbon fractions resulting from conversion of the individual solvent components in the hydrogenated, process-derived mixed solvent system. Furthermore, the first non-distillable effluent stream, in addition to containing heavy hydrocarbon fractions having atmospheric boiling points ranging from at least about 850° F. and greater and derived from the heavy hydrocarbon material being added to reaction zone 12, will also contain heavy hydrocarbon fractions of similar boiling points derived from the conversion of the individual solvent components in the hydrogenated, process-derived mixed solvent system.

In slurry preparation zone 22, the combined first non-distillable effluent stream and hydrotreated, process-derived mixed solvent system are admixed with a carbonaceous material, defined hereinbelow, said carbonaceous material being introduced into slurry preparation zone 22 through conduit 6. The amount of carbonaceous material that is added to slurry preparation zone 22 through conduit 6 can vary over a wide range. Generally, however, the amount will be such as to provide weight ratios of the total +850° F. boiling fractions in the combination of the first non-distillable effluent stream and said hydrogenated, process-derived mixed solvent system to the carbonaceous material, calculated on a moisture and ash free (MAF) basis, within said slurry preparation zone 22 ranging from about 0.1 to about 1.5 and preferably from about 0.5 to about 1.4 parts by weight of said +850° F. boiling fractions per each part by weight of the MAF carbonaceous material. As employed herein, the term "+850° F. boiling fractions" means those heavy hydrocarbon fractions in said first non-distillable effluent stream and said hydrotreated, process-derived mixed solvent system having atmospheric boiling points of at least about 850° F. and higher. Furthermore, the weight ratio of the hydrotreated, process-derived, mixed solvent system combined with said first non-distillable effluent stream in conduit 14 or added directly to slurry preparation zone 22 will range from about 0.1 to about 2.7 and preferably from about 0.6 to about 1.7 parts by weight per each part by weight of the combined weight of the carbonaceous material and +850° F. boiling fractions in slurry preparation zone 22.

In general, the slurry of the first non-distillable effluent stream, hydrogenated, process-derived mixed solvent system, carbonaceous material and disposable metal catalyst, said catalyst being carried forward from reaction zone 12 through conduit 14 to slurry preparation zone 22, will be heated to from about 300° F. to about 450° F. in said slurry preparation zone 22 to impart desirable pumping characteristics to the slurry. The warm pumpable slurry then is conveyed through conduit 24 to liquefaction zone 32. The slurry in conduit 24 is combined with hydrogen or hydrogen-containing gas introduced into conduit 24 through conduit 26. The hydrogen or hydrogen-containing gas introduced into conduit 24 and combined with the slurry therein conveniently may be obtained from an off-gas cleanup plant (not shown) or makeup hydrogen gas, said gases generally having a hydrogen content above 80% by volume on a dry basis, such as, for example, the hydrogen or hydrogen-containing gases generated in the practice of the method of the present invention. If desired, a synthesis gas, which is a mixture of hydrogen and carbon monoxide, may be used.

The hydrogen-containing slurry in conduit 24 then is, generally, further heated (by means not shown) to a temperature ranging from about 650° F. to about 850° F. and preferably from about 750° F. to about 825° F. prior to its introduction into liquefaction zone 32.

In liquefaction zone 32, the hydrogen-containing slurry introduced thereto through conduit 24 is subjected to sufficiently elevated conditions of temperature and pressure to effect conversion of at least about 50 percent by weight and preferably at least about 75 percent by weight and more of the combined solid carbonaceous constituent and +850° F. or higher boiling fractions in the slurry to more desirable liquid products.

The temperatures employed in operating liquefaction zone 32 should be sufficiently high to result in fast conversion and hydrogenation rates. The upper limit will be the temperature at which the carbonaceous material, the constituents of the first non-distillable effluent stream or a component of the hydrotreated, process-derived mixed solvent system in the slurry substantially are decomposed during the period of treatment. In general, the temperature of the slurry in said liquefaction zone 32 may range from about 700° F. to about 850° F. and preferably from about 775° F. to about 840° F. During the period of treatment of the slurry in liquefaction zone 32, the pressure therein preferably will be maintained within the range of from about 500 to about 3,000 psig, and preferably from about 1,500 to about 2,500 psig.

The slurry of the first non-distillable effluent stream, carbonaceous material, disposable catalyst and hydrogenated, process-derived mixed solvent system will be retained in liquefaction zone 32 for a sufficient period of time to achieve at least the conversions disclosed hereinabove. Generally, such period of time, necessary to achieving the extent of solvation noted above, will range from about 0.2 to about 2.5 hours. However, experience has shown that the aforementioned extents of solvation readily can be achieved within periods of time ranging from about 0.5 to about 1.0 hours.

During treatment of the slurry in liquefaction zone 32, any gaseous components, including, for example, excess hydrogen, oxides of carbon, hydrogen sulfide, ammonia and any vaporous conversion products derived from the first non-distillable effluent stream and carbonaceous material in the slurry such as, for example, $C_1$–$C_5$ lower alkyl hydrocarbons, are separated from the slurry mixture and conveyed through conduit 36 to a cleanup point (not shown) for recovering at least the hydrogen component for recycle in the process. Alternatively, such gaseous components and vaporous conversion products may be discharged, together with the treated slurry, through conduit 34 to a separate gas/liquids separation zone (not shown), wherein removal of said gaseous components and vaporous conversion products can be readily effected. The remaining, largely gas-free slurry (also referred to herein as the liquefaction product stream) in said gas/liquids separation zone (not shown) will then be conveyed through a suitable conduit (not shown) to fractionation zone 42. When employing a separate gas/liquids separation zone for removal of gaseous components and vaporous conversion product from the slurry withdrawn from liquefaction zone 32 by way of conduit 34, the temperatures and pressures employed within said zone generally will range from about 850° F. to about 250° F. and from about 3,000 psig to about atmospheric pressure, respectively.

The liquefaction product stream exiting liquefaction zone 32 through conduit 34 or gas/liquid separation zone (not shown) through a suitable conduit (not shown) then is conveyed to fractionation zone 42, wherein it is subjected to predetermined conditions of temperature and pressure to effect the separation from said liquefaction product stream various distillate streams containing carbonaceous and heavy hydrocarbon-derived liquid conversion products. In general, fractionation zone 42 can comprise two or more stills or distillation towers connected in series, each succeeding still or tower in the series being operated at the same or successively higher temperatures and successively lower pressures to effect the desired separations. The final distillation of the liquefaction product stream will be carried out in fractionation zone 42 at temperatures of about 450° F. to about 650° F. and under a vacuum of, for example, a pressure of about 3.0 to about 0.1 psi absolute. The distillate stream recovered by this final distillation then is removed from fractionation zone 42 by way of conduit 46. At least a portion of this distillate stream is recycled to hydrogenation zone 82 through conduit 48 communicating with conduit 46. The portion of this distillate stream conveyed to hydrogenation zone 82 through communicating conduits 46 and 48 will be an amount which, when combined with the portion of process-derived deashed light resid solvent from separation zone 72, is capable of providing the quantities of hydrogenated, process-derived mixed solvent system necessary to give the weight ratios of said solvent system to the combined carbonaceous/heavy hydrocarbon-derived +850° F. boiling fractions in slurry preparation zone 22 as specified above.

The distillate stream removed from fractionation zone 42 and conveyed, by way of conduits 46 and 48, to hydrogenation zone 82 constitutes the process-derived distillate solvent employed in preparing the hydrotreated, mixed solvent system utilized in the illustrated, most preferred embodiment of the method of the present invention. This distillate stream can be characterized by the fact that about 90 percent and usually 95 percent or more of the conversion products comprising this stream have atmospheric boiling points in the range of from about 500° F. to about 850° F. Conversely, the distillate stream can be further characterized in that only about 10 percent or less of the conversion products therein have atmospheric boiling points greater than about 850° F.

The second non-distillable effluent stream resulting from the fractionation of the liquefaction product stream in fractionation zone 42 then is withdrawn from said fractionation zone 42 through conduit 44. This second non-distillable effluent stream comprises unconverted carbonaceous material, mineral ash, spent disposable metal catalyst, metals from the original heavy hydrocarbon material and heavy and light resid components either initially present in or derived from the first non-distillable stream and carbonaceous component in the slurry introduced into liquefaction zone 32. This second non-distillable effluent stream then is itself subjected to further separation by techniques known in the coal liquefaction art as critical solvent deashing. A representative, but non-inclusive, list of references disclosing and describing various critical solvent deashing techniques includes U.S. Pat. Nos. 3,607,716; 3,607,717; 3,607,718; 4,028,219; 4,070,268; 4,119,524 and 4,164,466. The teachings of these reference patents relating to techniques for the critical solvent deashing of liquefied coal product streams, which teachings are applicable to the separation of the second non-distillable effluent stream generated through the utilization of the method of the present invention, are incorporated herein, in their entirety, by reference.

Referring once again to the single FIGURE, the second non-distillable effluent stream withdrawn from fractionation zone 42 is conveyed through conduit 44 to first separation zone 52. A critical solvent deashing-type solvent, which is defined in greater particularity hereinbelow, then is introduced into first separation zone 52 through conduit 50. An amount of said extraction solvent is added sufficient to provide a ratio of said solvent to the second non-distillable stream in first preparation zone 52 of from about 1:1 to about 10:1 on a weight basis. In first separation zone 52 which will comprise, for example, a separating vessel, elevated temperatures and pressures are maintained sufficient to effect a separation of the mixture of the second non-distillable effluent stream and extraction solvent into a first heavy phase containing a solvent insoluble ash fraction (comprising unconverted carbonaceous material, mineral ash, spent disposable catalyst and metals and some solvent soluble +850° F. boiling fractions from both the original carbonaceous and heavy hydrocarbon feed materials and some solvent and a first light phase comprising the substantial bulk of the solvent and solvent-soluble conversion products derived from both the residual heavy hydrocarbon materials in the first non-distillable stream and the carbonaceous material contained in the slurry introduced into liquefaction zone 32). In general, this first separation zone 52 is maintained at a temperature level in the range of from about 400° F. to about 700° F., and the pressure level is maintained in the range of from about 600 psig to about 1500 psig.

The particular temperature and pressure conditions, set forth immediately above, are selected to maximize the solid matter content of the second non-distillable effluent stream in the first heavy phase. These specific conditions also maximize the concentration of recoverable solvent-soluble conversion products in the second non-distillable effluent stream removal from fractionation zone 42 in the first light phase.

The first light phase is withdrawn from first separation zone 52 through conduit 54 and introduced into second separation zone 62, comprising, for example, a second separating vessel. Second separation zone 62 is maintained at a temperature level higher than the temperature level in first separation zone 52 and a pressure level substantially the same or below the pressure level in first separation zone 52 to effect a separation of the first light phase therein. Preferably, the temperature level in second separation zone 62 is maintained in the range of from about 410° F. to about 750° F., and the pressure level therein is maintained in the range of from about 600 psig to about 1500 psig.

The particular temperature and pressure conditions in second separation zone 62 are selected to provide a differential in the solvent density in the first light phase sufficiently large to cause the first light phase to separate into two fluid-like phases. Thus, the first light phase separates into a second heavy phase comprising a deashed heavy resid fraction containing hydrocarbon products derived from both the residual heavy hydrocarbon fractions in the first non-distillable effluent stream and the carbonaceous material and a second light phase containing the lighter conversion products derived therefrom.

The second heavy phase, or deashed heavy resid fraction, is withdrawn from second separation zone 62 through conduit 66 and may be processed to recover any extraction solvent therein and the hydrocarbon values thereof. For example, the second heavy phase or deashed heavy resid fraction may be introduced into a flash zone (not shown) to effect recovery of any extraction solvent which may be volatilized therein. The deashed heavy resid fraction remaining after flashing may then be introduced into subsequent processing equipment (not shown) to recover the hydrocarbon values within this heavy resid fraction.

Alternatively, a portion of this second heavy phase or deashed heavy resid fraction withdrawn from separation zone 62 through conduit 66 can be conveyed to and introduced into hydrogenation zone 82. Therein, it will be blended with and hydrogenated along with the process-derived distillate solvent and process-derived deashed light resid solvent to form a hydrotreated, process-derived, mixed solvent system for use in this most preferred embodiment of this invention. Such portion of the second heavy phase or deashed heavy resid fraction can also be combined with the process-derived distillate and deashed light resid solvents to form a non-hydrotreated mixed solvent system useful in the practice of this invention.

The second light phase, comprising solvent-soluble hydrocarbon products derived from both the residual heavy hydrocarbon fractions in the first non-distillable stream and the carbonaceous material and extraction solvent, is withdrawn from second separation zone 62 and introduced into third separation zone 72, comprising, for example, a third separation vessel, through conduit 64. Third separation zone 72 is maintained at a temperature level higher than the temperature level maintained in second separation zone 62 and at a pressure level substantially no greater than the pressure level in second separation zone 62. Preferably, the temperature level within third separation zone 72 is maintained in the range of from about 500° F. to about 950° F., and the pressure level in third separation zone 72 is maintained in the range of from about 40 psig to about 1450 psig. Under these conditions of temperature and pressure, a separation of the second light phase into a third heavy phase, comprising a deashed light resid fraction containing hydrocarbon products derived from both the residual heavy hydrocarbon fractions in the first non-distillable effluent stream and carbonaceous material utilized to prepare the feed slurry, and a third light phase, comprising the extraction solvent, is effected. Again, the particular temperatures and pressure conditions in third separation zone 72 are selected to effect the maximum separation of these hydrocarbon products by providing a differential in the solvent density in the second light phase sufficiently large to cause the second light phase to separate into the two fluid-like phases.

The third heavy phase, or deashed light resid fraction, is withdrawn from third separation zone 72 through conduit 74. At least a portion of said deashed light resid fraction is conveyed to hydrogenation zone 82 through conduit 78 communicating with said conduit 74 and constitutes the process-derived, deashed light resid solvent employed in preparing the hydrotreated, mixed solvent system utilized in this most preferred embodiment of the present invention. The portion of the deashed light resid fraction withdrawn from third separation zone 72 through conduit 74 and conveyed to hydrogenation zone 82 through conduit 78 in communication with said conduit 74 will be an amount which, when combined with the distillate stream recovered from fractionation zone 42, is capable of providing the quantities of the hydrotreated, process-derived mixed solvent system necessary to give the weight ratios of said solvent system to the combined carbonaceous/-heavy hydrocarbon-derived +850° F. boiling fractions in slurry preparation zone 22 as specified above. Any remaining deashed light resid fraction not conveyed to hydrogenation zone 82 may be conveyed to a flash zone (not shown), wherein any solvent which remains in said deashed light resid fraction can be volatized therein and recovered.

The third light phase, comprising the solvent utilized in the extraction of the second non-distillable effluent stream introduced into first separation zone 52 by way of conduit 44, is withdrawn from third separation zone 72 through conduit 76 and conveyed to conduit 50, wherein it is combined with fresh or makeup solvent for introduction into first separation zone 52.

The term "solvent", "extraction solvent" or "deashing-type solvent" is intended to mean those fluids which are sometimes described as "light organic solvents", as that term is employed, for example, in U.S. Pat. Nos. 3,607,716; 3,607,717; 3,607,718; 4,028,219; 4,070,268; 4,119,524 and 4,164,466. More specifically, the solvent consists essentially of at least one substance having a critical temperature below 800° F. and selected from the group consisting of aromatic hydrocarbons having a single benzine nucleus and normal boiling points below about 310° F., cycloparaffin hydrocarbons having normal boiling points below about 310° F., open-chain monoolefin hydrocarbons having boiling points below about 310° F., open-chain saturated hydrocarbons having normal boiling points below about 300° F., mono-, di- and tri-open-chain amines containing from about 2 to about 8 carbon atoms, carbocyclic amines having a monocyclic structure containing from about 6 to about 9 carbon atoms, heterocyclic amines containing from about 5 to about 9 carbon atoms and phenols containing from about 6 to about 9 carbon atoms, and homologues thereof. Representative, but non-limiting, examples of suitable solvents for use in the method of the present invention include benzene, toluene, o-, m- and p-xylene, isopropylbenzene, pentane, hexane, heptane, octane, nonane, butene, pentene, hexene, heptene, phenol, and the like.

As disclosed hereinabove, at least a portion of the distillate stream removed from fractionation zone 42, comprising a process-derived distillate solvent, and at least a portion of the deashed light resid fraction removed from third separation zone 72, comprising a process-derived, deashed, light resid solvent, are conveyed to and introduced into hydrogenation zone 82. Referring to the single FIGURE, said portions of the distillate stream from fractionation zone 42 and the deashed light resid fraction from said third separation zone 72 are introduced into hydrogenation zone 82 through communicating conduits 46 and 48 and communicating conduits 74 and 78, respectively. Within hydrogenation zone 82, the distillate stream and deashed light resid fraction, both of which contain carbonaceous and heavy hydrocarbon-derived product fractions having atmospheric boiling points of +850° F. and greater, are combined in such proportions as to provide an admixture thereof containing no more than about 50% by weight of said +850° F. and greater boiling point fractions. Hydrogen then is introduced into hydrogenation zone 82 through conduit 86 and the admixture of the distillate stream, deashed light resid solvent and hydrogen subjected to elevated temperatures and pressures in the presence of a hydrogenation catalyst and for a time sufficient to provide the hydrotreated, process-derived mixed solvent system employed in the co-processing method of this invention.

Temperatures employed in the preparation of the mixed solvent system in hydrogenation zone 82 can range from about 500° F. to about 800° F. and pressures employed in hydrogenation zone 82 can range from about 1,000 psig to about 3,000 psig. In general, the time required to effect hydrogenation of the admixture of said process-derived, distillate stream and process-derived deashed light resid fraction will range from about 0.25 to about 2.0 hours.

Hydrogenation catalysts, suitable for use in hydrogenation zone 82, include, for example, regenerative metal catalysts such as cobalt and molybdenum oxides on alumina, nickel oxide, nickel thiomolybdate, tungsten and nickel sulfides and vanadium oxide as well as the disposable metal catalysts disclosed above for use in liquefaction zone 32. These catalysts are introduced into hydrogenation zone 82 by means not shown. Preferred catalysts for use in hydrogenation zone 82 are the disposable iron oxide and iron sulfide catalysts utilized in reaction zone 12 and liquefaction zone 32. When employing a disposable iron oxide or iron sulfide catalyst, such catalyst may be conveyed, together with the hydrotreated, process-derived mixed solvent system to slurry preparation zone 22, through communicating conduits 84 and 14. In slurry preparation zone 22, it is combined with the disposable metal catalyst in the first non-distillable stream from reaction zone 12. The combined catalyst then is conveyed, together with the slurry admixture from slurry preparation zone 22, to liquefaction zone 32 wherein it functions to effect conversion of the carbonaceous material and heavy hydrocarbon-derived fractions having atmospheric boiling points of +850° F. and greater to more desirable hydrocarbon products.

In addition to the formation of the hydrotreated, process-derived mixed solvent system employed in the process of this invention, the hydrogenation of the admixture of said process-derived, distillate stream and deashed light resid fraction in said hydrogenation zone 82 also results in the formation of a mixed-byproduct gaseous stream. This stream is removed from hydrogenation zone 82 through conduit 88. This gaseous stream contains excess hydrogen, oxides of carbon, hydrogen sulfide, ammonia and other vaporous hydrocarbon products derived from the distillate stream and deashed light resid fraction components of the hydrogenation admixture and is conveyed through conduit 88 to a cleanup plant (not shown) for recovery of at least the hydrogen gas component in said gaseous stream. The hydrotreated mixed solvent system then is transported to reaction zone 12 via conduit 84.

The present invention is applicable to the sequential co-processing of any heavy hydrocarbon material and any carbonaceous material. As employed in the description and claims set forth herein, the term "carbonaceous material" is intended to include any coal but particularly a coal of a rank lower than anthracite. Representative, but non-limiting, examples of such coals include sub-anthracite, bituminous, sub-bituminous, lignite and brown coals. Peat may also by employed in the method of the present invention.

By the term "heavy hydrocarbon material" as employed in the description and claims set forth herein is meant pyrogenous and native bitumens or one or more fractions or components thereof; products obtained by treating these materials or one or more of their components or fractions with air or other oxygen-containing gas in the presence or absence of catalysts and products obtained by otherwise treating these materials. The pyrogenous bitumens include heavy or very low API gravity petroleum crudes, reduced crudes, either stream or vacuum refined, hard and soft wood pitches, coal tar residues, cracked tars, tall oil and the like. The term "otherwise treating" is intended to mean, for example, the condensation of asphalt-type materials in the presence of a suitable treating agent, such as catalysts of the Friedel-Crafts type, to produce heavier or more complex materials. The native bitumens include oil bearing shales, tar sands, gilsonite, wurtzlite, albertite and native asphalts such as, for example, Trinidad asphalt and the like. The carbonaceous materials and heavy hydrocarbon materials most suited to use in the method of the present invention are sub-bituminous coals and pyrogenous hydrocarbons such as the steam and vacuum refined reduced crudes.

The following example is offered for the purpose of illustrating the invention and not by way of limitation. In this example, all material amounts are by weight unless indicated otherwise.

EXAMPLE 1

To a one liter autoclave equipped with a magnetically driven stirrer are added 301.34 grams of Cold Lake bitumen (a crude oil from Cold Lake, Canada) and 5.0 grams of a finely divided iron oxide disposable catalyst. The autoclave is sealed, pressurized with pure hydrogen gas to about 1,400 pounds per square inch gauge (psig) pressure and heated to a temperature of about 825° F. This heating is continued for a period of one hour during which time a maximum pressure of 2,867 psig is observed.

At the end of this one hour heating period, the autoclave is cooled, depressurized and the reaction mixture therein recovered and subjected to distillation under a vacuum of 0.1 millimeters of mercury pressure and at a temperature of 240° F. Two fractions are recovered. One fraction is a distillate fraction containing materials having atmospheric boiling points up to about 650° F. and the other fraction is the distillation residue containing materials having atmospheric boiling points above about 650° F. The distillate residue also contains the finely divided iron oxide catalyst.

Ninety and sixty-six hundredths (90.66) grams of the distillation residue recovered above are then returned to the autoclave together with 100.0 grams of Ohio coal and 90.66 grams of a solvent mixture of a previously prepared process-derived heavy oil and a deashed light resid. Again, the autoclave is sealed and pressurized with hydrogen gas to a pressure of 1,400 psig and heated for a period of one hour at a temperature of 825° F. During this period, the maximum pressure that is observed is about 2,867 psig.

On completion of the one hour heating period, the autoclave is cooled and depressurized, with collection of a gaseous stream containing excess hydrogen and by-product gases. The reaction mixture remaining in the autoclave then is removed therefrom and subjected to distillation under a pressure of 0.1 millimeters of mercury pressure and at a temperature of 400° F. Again, two fractions are recovered. One fraction is a distillate fraction containing materials which, under atmospheric conditions, have boiling points up to about 850° F., and the other fraction is the non-distillable residue containing materials which, under atmospheric conditions, have boiling points of above about 850° F.

The characteristics of the various starting materials are given in Table I and of the finely divided iron oxide catalyst in Table II. Table III contains data relating to characteristics of the various gaseous, distillable and non-distillable fractions recovered from the second distillation.

TABLE I

| Analysis Wt. % | Cold Lake Bitumen | Ohio Coal | Mixed Solvent System |
|---|---|---|---|
| Hydrogen | 10.36 | 5.43 | 8.36 |
| Carbon | 84.00 | 74.10 | 90.20 |
| Nitrogen | 0.42 | 1.45 | 0.52 |
| Sulfur | 4.06 | 3.20 | 0.10 |
| Oxygen[a] | 1.14 | 9.05 | 0.68 |
| Ash | 0.02 | 6.77 | 0.14 |
| +850° F. fraction[b], wt. % | 62.58 | — | 47.36 |

[a]By difference.
[b]Weight percent of hydrocarbons in component having atmospheric boiling points of 850° F. or more.

TABLE II

| Analysis of Iron Oxide | |
|---|---|
| Surface Area, $m^2/g$ | 4.5 |
| Moisture, wt. % | 0.6 |
| Chlorine, wt. % | 0.9 |
| Iron (total), wt. % | 67.3 |
| $Fe^{+2}$ | 2.4 |
| $Fe^{+3}$ | 64.9 |
| Other materials, wt. % | 31.2 |

TABLE III

| Product Components | Yields[a], Wt. % (Wt. in grams) Gas Fraction | Distillable Fraction | Non-distillable Fraction |
|---|---|---|---|
| $H_2$, CO and $CO_2$ | 3.36(9.48) | — | — |
| Sour Water | 3.22(9.09) | — | — |
| $C_1$ to $C_3$ hydrocarbons | 12.48(35.18) | — | — |
| $C_4$ to −850° F. hydrocarbons | — | 53.66(151.22) | — |
| +850° F. hydrocarbons | — | — | 26.07(73.47) |
| Coke | — | — | 2.99(8.42) |

[a]Calculated on the basis of the total weight (281.81 grams) of the +850° F. boiling point fractions in the Cold Lake bitumen and MAF Ohio coal.

While the present invention has been described with respect to that which at present is considered to be the preferred embodiment thereof, it is to be understood that changes and modifications can be made to the process without departing from the spirit and scope of the invention as defined by the following claims.

What is claimed is:

1. A method for sequentially co-processing a heavy hydrocarbon material and a carbonaceous material comprising the steps of:

subjecting a heavy hydrocarbon material comprising a residuum resulting from the refining of crude oil and containing +850° F. and higher boiling fractions to predetermined conditions of temperature and pressure in the presence of at least one disposable metal catalyst selected from the group consisting of iron oxides and iron sulfides in an amount ranging from about 0.1 parts to about 10 parts by weight per 100 parts by weight of said +850° F. and higher boiling fractions in said heavy hydrocarbon material to effect conversion of said heavy hydrocarbon material to and recovery of a first distillate stream and a first non-distillable effluent stream containing said disposable metal catalyst;

admixing said first non-distillable effluent stream containing said disposable metal catalyst with a carbonaceous material and at least one process-derived solvent selected from the group consisting of a process-derived distillate solvent and a process-derived deashed light resid solvent to provide a liquefaction slurry containing said disposable metal catalyst;

subjecting said liquefaction slurry to predetermined conditions of temperature and pressure in the presence of hydrogen and said disposable metal catalyst to provide a liquefaction product stream containing a mixture of products substantially derived from said first non-distillable effluent stream and said carbonaceous material;

fractionating said liquefaction product stream at predetermined conditions of temperature and pressure to separate and recover from said liquefaction product stream a second distillate stream, said second distillate stream providing a source of the process-derived distillate solvent, and to provide a second non-distillable effluent stream; and subjecting said second non-distillable effluent stream to critical solvent extraction at predetermined conditions of temperature and pressure with a solvent having a critical temperature below about 800° F., to separate and recover from said second non-distillable effluent stream a critical solvent insoluble ash fraction, a critical solvent soluble deashed heavy resid fraction and a critical solvent soluble deashed light resid fraction, said solvent soluble deashed light resid fraction providing a source of the process-derived deashed light resid solvent.

2. The method of claim 1, wherein said disposable metal catalyst is an iron oxide.

3. The method of claim 1, wherein said heavy hydrocarbon material is subjected to said elevated temperatures and pressures in the presence of at least one diluent oil selected from the group consisting of pyrogenous bitumen and native bitumen-derived oils and carbonaceous-derived oils.

4. The method of claim 3, wherein said diluent oil is a pyrogenous bitumen-derived oil.

5. The method of claim 1, wherein said heavy hydrocarbon material is subjected, in the presence of said disposable metal catalyst, to temperatures ranging from about 650° F. to about 900° F. and pressures ranging from about 500 psig to about 4,000 psig.

6. The method of claim 5, wherein said first distillate stream is a mixed hydrocarbon stream having an atmospheric boiling point of up to about 850° F.

7. The method of claim 5, wherein said first non-distillable effluent stream is a mixed hydrocarbon stream having an atmospheric boiling point of at least about 850° F.

8. The method of claim 1, wherein said process-derived solvent is a process-derived mixed solvent system comprising a mixture of said process-derived distillate solvent and said process-derived deashed light resid solvent.

9. The method of claim 8, wherein said process-derived mixed solvent system admixed with said heavy hydrocarbon material is a hydrotreated mixed solvent system prepared by heating said mixture of the process-derived distillate solvent and said process-derived deashed light resid solvent at temperatures ranging from about 500° F. to about 800° F. and at pressures ranging from about 1,000 psig to about 3,000 psig in the presence of hydrogen and at least one hydrogenation catalyst.

10. The method of claim 9, wherein said hydrogenation catalyst is at least one compound of a metal selected from the group consisting of iron, nickel and molybdenum.

11. The method of claim 10, wherein said hydrogenation catalyst is a disposable hydrogenation catalyst selected from the group consisting of iron oxides and iron sulfides.

12. The method of claim 11, wherein said disposable hydrogenation catalyst is an iron oxide.

13. The method of claim 1, wherein said carbonaceous material is a sub-bituminous coal.

14. The method of claim 1, wherein said first non-distillable effluent stream and said carbonaceous material are admixed in such proportion to provide a weight ratio of said first non-distillable effluent stream to said carbonaceous material in said liquefaction slurry ranging from about 0.1 to about 1.5 parts by weight of +850° F. boiling fractions in said first non-distillable effluent stream per each part by weight of said carbonaceous material.

15. The method of claim 1, wherein said liquefaction slurry is subjected to temperatures ranging from about 700° F. to about 850° F. and pressures ranging from about 500 psig to about 3,000 psig.

16. The method of claim 15, wherein said liquefaction slurry is subjected to said temperatures and said pressures in the presence of at least one material selected from the group consisting of hydrogen sulfide gas and sulfur-containing compounds capable of forming hydrogen sulfide gas at said temperatures and pressures.

17. The method of claim 1, wherein said liquefaction product stream is subjected to fractionation to separate and recover from said liquefaction product stream, at temperatures ranging from about 450° F. to about 650° F. and at pressures ranging from about 3.0 psi absolute to about 0.1 psi absolute, said second distillate stream and said second non-distillable effluent stream.

18. The method of claim 1, wherein said second non-distillable effluent stream is subjected to critical solvent extraction at temperatures ranging from about 400° F.

to about 950° F. and at pressures ranging from about 40 psig to about 1,500 psig utilizing a solvent having a normal atmospheric boiling point below about 310° F.

19. The method of claim 18, wherein said second non-distillable effluent stream is subjected to critical solvent extraction at temperatures ranging from about 400° F. to about 700° F. and at pressures ranging from about 600 psig to about 1,500 psig utilizing a solvent having a normal atmospheric boiling point below about 310° F. to recover a solvent insoluble ash fraction and provide a first light phase.

20. The method of claim 19, wherein said first light phase is further heated at temperatures ranging from about 410° F. to about 750° F. at pressures ranging from about 600 psig to about 1,500 psig to recover the solvent soluble deashed heavy resid fraction and provide a second light phase.

21. The method of claim 20, wherein said second light phase is further heated at temperatures ranging from about 500° F. to about 950° F. at pressures ranging from about 40 psig to abour 1,450 psig to recover the solvent soluble deashed light resid fraction.

* * * * *